US009206797B2

(12) United States Patent
Han De Man et al.

(10) Patent No.: US 9,206,797 B2
(45) Date of Patent: Dec. 8, 2015

(54) BELLOWS FOR A PUMP DEVICE

(71) Applicant: MeadWestvaco Calmar Netherlands BV, Richmond, VA (US)

(72) Inventors: Eelco Han De Man, Vlimen (NL); Stefan Koster, Rotterdam (NL)

(73) Assignee: MeadWestvaco Calmar Netherlands BV, Norcross, GA (US)

( * ) Notice: Subject to any disclaimer, the term of this patent is extended or adjusted under 35 U.S.C. 154(b) by 171 days.

(21) Appl. No.: 13/914,827

(22) Filed: Jun. 11, 2013

(65) Prior Publication Data

US 2014/0147318 A1 May 29, 2014

Related U.S. Application Data

(63) Continuation-in-part of application No. 13/871,513, filed on Apr. 26, 2013, which is a continuation-in-part of application No. 13/689,136, filed on Nov. 29, 2012.

(51) Int. Cl.

| | |
|---|---|
| ***B05B 11/02*** | (2006.01) |
| ***F04B 45/02*** | (2006.01) |
| ***F04B 43/00*** | (2006.01) |
| ***B05B 11/00*** | (2006.01) |

(52) U.S. Cl.

CPC ..... *F04B 45/02* (2013.01); *B05B 11/007* (2013.01); *B05B 11/0064* (2013.01); *B05B 11/3032* (2013.01); *B05B 11/3033* (2013.01); *B05B 11/3035* (2013.01); *B05B 11/3036* (2013.01); *B05B 11/3064* (2013.01); *F04B 43/0063* (2013.01); *B05B 11/0043* (2013.01)

(58) Field of Classification Search

CPC ..... F05B 11/3035; F05B 11/3036; F05B 11/3033; F05B 11/3032; F05B 11/3064; F05B 11/3018; F05B 11/0043; F05B 11/0067; F05B 11/007; F04B 45/02; A47K 5/1208

USPC ..... 417/479, 374; 222/107, 207, 209, 212, 222/213, 214, 215, 380, 495, 383.1, 496

See application file for complete search history.

(56) References Cited

U.S. PATENT DOCUMENTS

| | | | | |
|---|---|---|---|---|
| 2,943,417 | A | 7/1960 | Greenspan | |
| 3,130,877 | A | 4/1964 | Miller | |
| 3,715,060 | A * | 2/1973 | Benson | 222/207 |
| 3,752,366 | A | 8/1973 | Lawrence, Jr. | |

(Continued)

FOREIGN PATENT DOCUMENTS

| | | | |
|---|---|---|---|
| CH | 680358 | A5 | 8/1992 |
| DE | 29823309 | U1 | 8/1999 |

(Continued)

OTHER PUBLICATIONS

International Search Report from PCT/EP2013/074778 mailed Mar. 31, 2014.

(Continued)

*Primary Examiner* — Devon Kramer
*Assistant Examiner* — Nathan Zollinger
(74) *Attorney, Agent, or Firm* — WestRock Intellectual Property Group

(57) ABSTRACT

A bellows pump having an inlet passage, interior chamber and discharge passage and also having a base and unitary valve member. The pump possesses an improved valve configuration as well as an improved bellows/base configuration, among other things.

10 Claims, 16 Drawing Sheets

(56) References Cited

U.S. PATENT DOCUMENTS

| | | | | |
|---|---|---|---|---|
| 3,987,938 | A | 10/1976 | Cooprider et al. | |
| 4,168,020 | A | 9/1979 | Benson | |
| 4,197,265 | A | 4/1980 | Burke | |
| 4,330,071 | A * | 5/1982 | Ohlson | 222/207 |
| 4,394,936 | A | 7/1983 | Shavit | |
| 4,830,284 | A | 5/1989 | Maerte | |
| 5,518,147 | A | 5/1996 | Peterson et al. | |
| 5,524,795 | A | 6/1996 | Lee | |
| 5,860,567 | A | 1/1999 | Fuchs et al. | |
| 5,871,126 | A * | 2/1999 | Bennett et al. | 222/207 |
| 6,012,613 | A * | 1/2000 | Chen | 222/207 |
| 6,158,620 | A | 12/2000 | Polan | |
| 6,216,916 | B1 * | 4/2001 | Maddox et al. | 222/105 |
| 6,241,122 | B1 | 6/2001 | Araki et al. | |
| 6,419,117 | B1 | 7/2002 | Bosch | |
| 6,971,553 | B2 | 12/2005 | Brennan et al. | |
| 7,322,491 | B2 | 1/2008 | Py et al. | |
| 7,891,583 | B2 | 2/2011 | Sayers et al. | |
| 7,931,173 | B2 | 4/2011 | Yuan | |
| 2002/0074359 | A1 * | 6/2002 | Weber | 222/209 |
| 2008/0029547 | A1 * | 2/2008 | Yuan | 222/207 |
| 2008/0035677 | A1 * | 2/2008 | Daansen | 222/310 |
| 2008/0116226 | A1 | 5/2008 | Py et al. | |
| 2008/0156829 | A1 | 7/2008 | Chen | |
| 2009/0183371 | A1 | 7/2009 | Mileti et al. | |
| 2009/0285510 | A1 | 11/2009 | Huang | |
| 2010/0320226 | A1 | 12/2010 | Nilsson | |
| 2011/0031278 | A1 | 2/2011 | Han de Man | |
| 2012/0014824 | A1 | 1/2012 | Han De Man | |
| 2012/0097709 | A1 | 4/2012 | Han De Man | |

FOREIGN PATENT DOCUMENTS

| | | | |
|---|---|---|---|
| DE | 10330040 | | 1/2005 |
| DE | 102005012506 | A1 | 1/2007 |
| EP | 1561515 | | 8/2005 |
| EP | 1886736 | A1 | 2/2008 |
| EP | 2052786 | | 4/2009 |
| EP | 2251655 | A1 | 11/2010 |
| FR | 2127774 | A5 | 10/1972 |
| FR | 2976981 | | 12/2012 |
| GB | 2150226 | A | 6/1985 |
| JP | 63161152 | U | 10/1988 |
| WO | WO9953388 | A1 | 10/1999 |
| WO | WO03/084673 | | 10/2003 |
| WO | WO2010089501 | A1 | 8/2010 |
| WO | WO2010/105642 | | 9/2010 |
| WO | WO2010117754 | | 10/2010 |
| WO | WO2010117754 | A2 | 10/2010 |
| WO | WO2011099309 | A1 | 8/2011 |
| WO | WO 2013/135883 | | 9/2013 |

OTHER PUBLICATIONS

International Search Report from PCT/EP2013/074763 dated Mar. 13, 2014.

International Search Report for PCT/US2010/029140 published as WO2010117754A3 on Oct. 14, 2010.

International Search Report and Preliminary Report for PCT/US2011/057781 published on May 3, 2012.

European Search Report on EP11182255, published on Jan. 22, 2013.

International Search Report for PCT/US2012/065527 published on Feb. 14, 2013.

* cited by examiner

BELLOWS FOR A PUMP DEVICE

CROSS-REFERENCE TO RELATED APPLICATIONS

This application is a continuation-in-part application of, and claims the benefit of and priority to, U.S. application Ser. No. 13/871,513, entitled "VALVES AND PUMPS USING SAID VALVES," filed 26 Apr. 2013, which is a continuation-in-part application of U.S. application Ser. No. 13/689,136, entitled "VALVES AND PUMPS USING SAID VALVES," filed 29 Nov. 2012, and incorporates the same herein by reference in their entireties.

BACKGROUND OF THE INVENTION

1. Field of the Invention

Embodiments of the invention relate to bellows for pump devices and more particularly to improved bellows which may facilitate easier pumping or actuation of a pump device and may improve the performance of a pump device.

2. State of the Art

The personal and beauty care markets utilize a wide variety of different pump mechanisms and devices for delivering fluid-based product to a user. Such pump devices include traditional pumps using ball valves or flap valves. Unique pump devices may also increase the aesthetic value or appeal of the pump device or provide unique functionality to a pump device. For example, as illustrated and described in WO2010/117754, which is incorporated herein in its entirety by reference, a pump may include a base having an inlet passage, an interior chamber, and a discharge passage. A valve having a valve stem, an outlet valve at one end of the valve stem and an inlet valve or valve disc at an opposite end of the valve stem, may be seated in the base such that the outlet valve may open and close a passage through the discharge passage and the inlet valve or valve disc may open and close a passage from a container into the interior chamber of the base. A bellow or bellows dome may be secured to the base by a cap. Actuation of the bellow dome may open or close the outlet valve of the pump.

A pump 300 as described in WO20110/1117754 is illustrated in FIG. 1 and the components thereof are illustrated in FIGS. 2A through 2D. In particular, a pump 300 may include a base 310 having an inlet passage 312, an interior chamber 314, and a discharge passage 318. A valve 330 may be positioned in the base and may include a valve stem 333, an outlet valve 339 at one end of the valve stem 333 and engaged with the discharge passage 318 in a closed position, and a valve disc 336 at a valve stem 333 end opposite the outlet valve 339, engaged with or acting as an inlet valve in the inlet passage 312. A bellows 350 or bellows may be secured to the base 310 with a cap 380. The base 310 may be secured to an attachment adapter 325 or container.

White the pumps and assemblies illustrated and described in WO2010/117754 may provide sufficient operation, improvements to the bellow or bellows may be desirable to improve the functionality of the pump.

BRIEF SUMMARY OF THE INVENTION

According to certain embodiments of the invention, a valve for a pump assembly may include an improved valve stem. According to certain embodiments of the invention, a valve stem may be improved by providing a thicker cross-sectional area than used with prior valve devices. According to other embodiments of the invention, a valve stem may be improved by providing a geometric shaped cross-sectional area such that the geometric shape may provide increased stiffness to the valve and the valve stem.

According to still other embodiments of the invention, an improved valve may include an outlet valve portion having a conical shape. In some embodiments of the invention, a conically shaped outlet valve may be configured to seat in a conically shaped discharge passage of a pump base.

According to other embodiments of the invention, an improved valve may include both an improved valve stem configuration and an improved outlet valve. For example, an improved valve according to various embodiments of the invention may include a conical outlet valve and a valve stem having a width substantially similar to the largest diameter of the conical outlet valve. In other embodiments, an improved valve may include a conical outlet valve and a valve stem having a cross-shaped cross-sectional area. In still other embodiments, an improved valve may include a conical outlet valve and a valve stem having one or more support ribs running at least a partial length of the valve stem.

According to still other embodiments of the invention, an improved outlet valve may include one or more steps in the outlet valve portion. An outlet valve having one or more steps may allow the collection of particulate matter in the regions of the one or more steps so that such particulates do not hinder operation of the outlet valve.

According to still other embodiments of the invention, an improved outlet valve may include a valve seal portion seated against an interior wall of a pump, one or more surfaces extending from the valve seal portion towards a valve stem, and a pocket formed between the outlet valve and an interior wall of a pump in which the outlet valve is seated.

According to other embodiments of the invention, an improved pump may include a bellow or bellows having a bellows rim with an outer rim ring and an inner rim ring. The inner rim ring may include a continuous inner rim ring or a segmented inner rim ring having two or more inner rim ring segments. In some embodiments of the invention, the outer rim ring may rest on a portion of the base. In other embodiments, both the outer rim ring and the inner rim ring may rest on a portion of the base, for example on a bellows support shelf. In still further embodiments, a pump base may include one or more bellows supports which may be positioned between an outer rim ring and an inner rim ring of a bellows.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
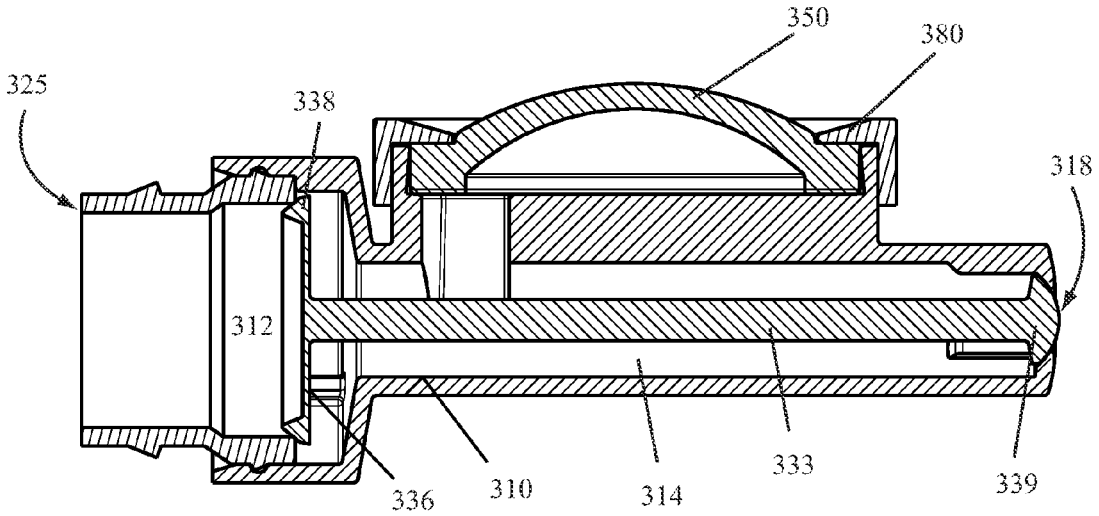
FIG. 1 (PRIOR ART)
FIG. 1 illustrates a pump and valve according to the prior art.
Figure 2A:
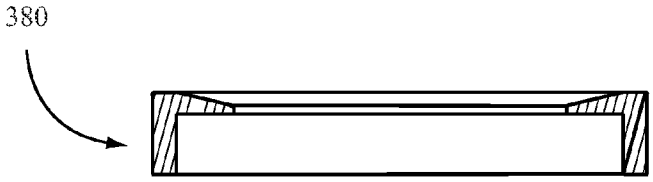
FIG. 2A (PRIOR ART)
FIGS. 2A through 2D illustrate components of a pump according to various prior art embodiments.
Figure 2B:
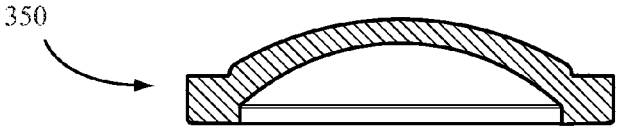
FIG. 2B (PRIOR ART)
Figure 2C:
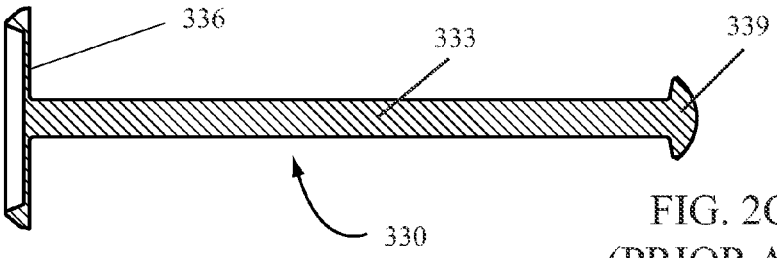
FIG. 2C (PRIOR ART)
Figure 2D:
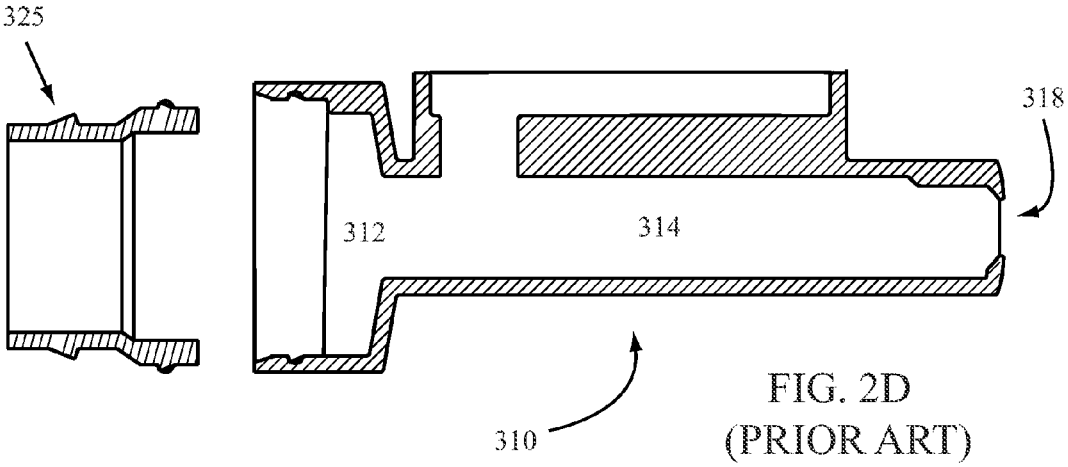
FIG. 2D (PRIOR ART)

According to certain embodiments of the invention, a valve 130 for a pump may include a valve stem 133, an outlet valve 139 and a valve disc 136. The outlet valve 139 and valve disc 136 may be on opposite ends of the valve stem 133.

A valve 130 according to various embodiments of the invention is illustrated in FIGS. 3 through 6. As illustrated, a valve 130 may include a valve stem 133 having an outlet valve 139 adjacent one end thereof and a valve disc 136, or inlet valve, located on an end of the valve stem 133 opposite the outlet valve 139. The outlet valve 139 may be rounded or have a circular or oval shape. According to various embodiments of the invention, a diameter of the outlet valve 139 may be configured or selected such that the outlet valve may seat against a discharge passage 318 of a pump to prevent discharge of a product from the pump until the valve stem 133 is moved, resulting in an unseating of the outlet valve 139 from a discharge passage 318.

According to some embodiments of the invention, a valve stem 133 may extend from the outlet valve 139 to a valve disc 136 at an opposite end thereof. A valve stem 133 may include a cross-sectional portion having a width as large as a diameter of the outlet valve 139 over at least a portion of the valve stem 133. At a portion of the valve stem 133 nearing the valve disc 136, the valve stem 133 may narrow or converge towards a central portion of the valve disc 136. For example, the valve 130 illustrated in FIGS. 3 through 6 includes a valve stem 133 having a cross-sectional width equal to the largest diameter of the outlet valve 139 over a portion of the valve stem 133. At a point near the valve disc 136, the valve stem 133 narrows or converges towards a central portion of the valve disc 136, creating a narrowed region in the valve stem 133 adjacent the valve disc 136.

Figure 4:
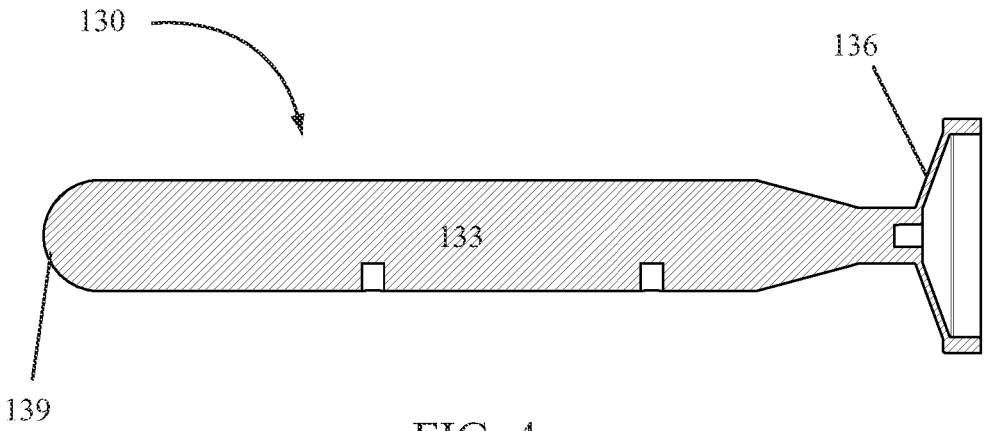
FIG. 4 illustrates a cross-sectional view of a valve along its length according to various embodiments of the invention.

As shown in the cross-sectional view of FIG. 4, the cross-sectional area of the valve stem 133 remains as thick as the cross-sectional diameter of the outlet valve 139 across a large portion of the valve stem 133. Only nearer the valve disc 136 does the cross-sectional area of the valve stem 133 begin to decrease or narrow.

Figure 3:
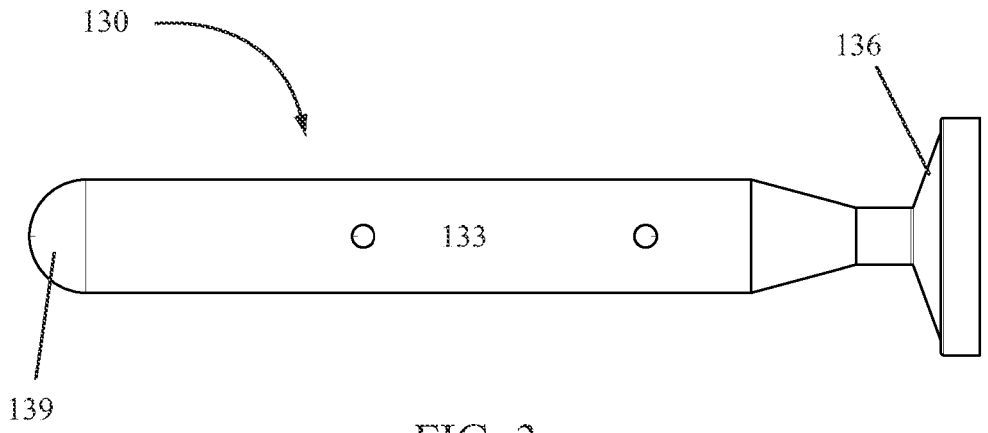
FIG. 3 illustrates a valve according to various embodiments of the invention.
Figure 5:
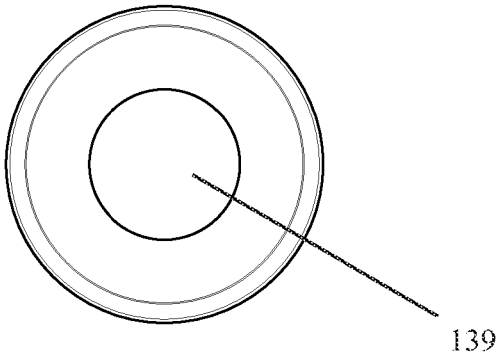
FIG. 5 illustrates a front view of a valve according to various embodiments of the invention.
Figure 6:
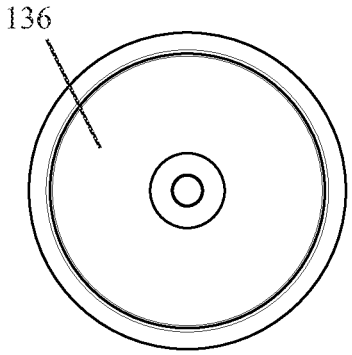
FIG. 6 illustrates a rear view of a valve according to various embodiments of the invention.

FIG. 5 illustrates a front view of the valve 130 illustrated in FIGS. 3 and 4 and FIG. 6 illustrates a rear view thereof. As illustrated, the diameter of the valve stem 133 at a forward portion of the valve stem 133 nearest the outlet valve 139 is greater than at the point where the valve stem 133 joins with the valve disc 136.

According to various embodiments of the invention, a valve 130 having a thicker valve stem 133—or a valve stem 133 with an initial width or shape equivalent to a cross-sectional area of the outlet valve 139—with a narrowing of the valve stem 133 adjacent to the valve disc 136 provides a stiffer or more rigid valve 130 than those of the prior art.

According to some embodiments of the invention, a valve stem 133 may be configured or shaped such that the cross-sectional area or width of the majority of the length of the valve stem 133 relative to the cross-sectional area or width of the valve stem 133 at the point of convergence with the valve disc 136 provides a desired force to resist movement of the valve stem 133 relative to the valve disc 136. In this manner, the force required to open an outlet valve 139 may be adjusted by changing the configuration of the valve stem 133 thickness along the valve stem 133 and at the point of convergence with the valve disc 136.

Figure 7:
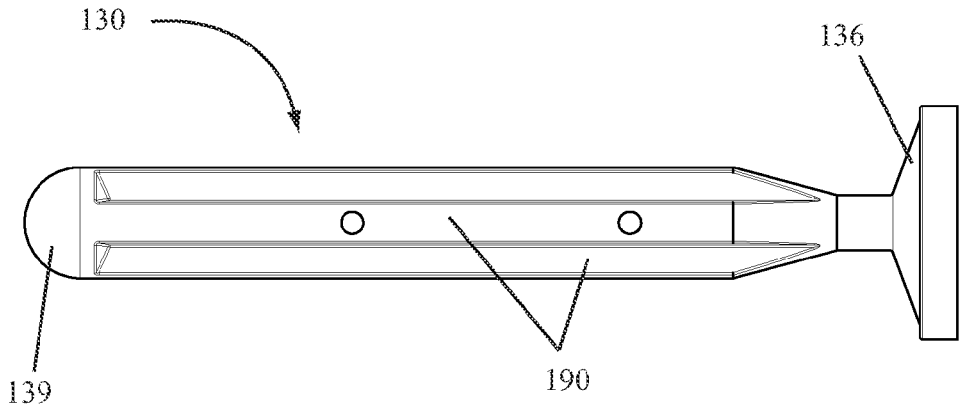
FIG. 7 illustrates a valve according to various embodiments of the invention.
Figure 8:
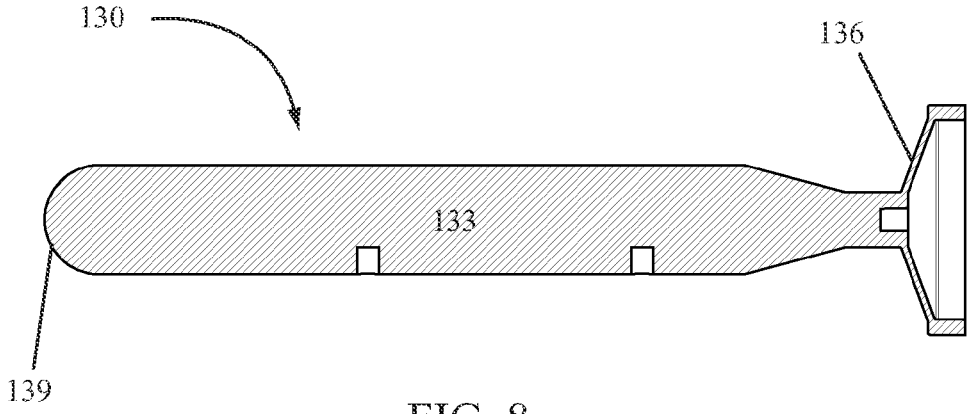
FIG. 8 illustrates a cross-sectional view of a valve along its length according to various embodiments of the invention.
Figure 9:
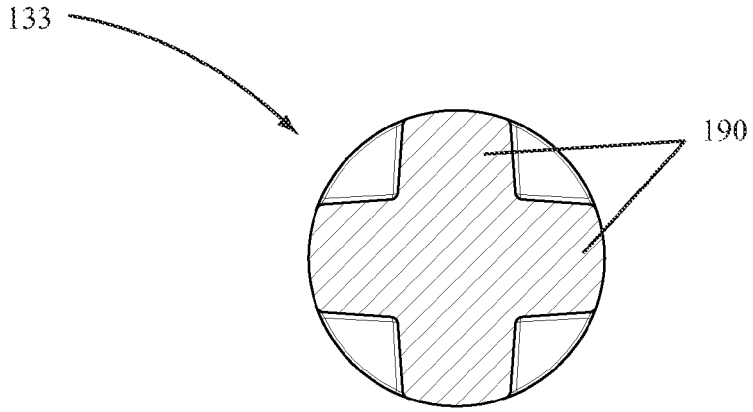
FIG. 9 illustrates a cross-sectional view of a valve along its width according to various embodiments of the invention.

A valve 130 according to other embodiments of the invention is illustrated in FIGS. 7 through 9. As illustrated, a valve 130 may have one or more ribs 190 or other stifling features running along a length—or part of a length—of the valve stem 133. In other embodiments, ribs 190 or stiffening features may run along portions of the width or circumference of a valve stem 133.

According to various embodiments of the invention, a valve stem 133 may include four ribs 190 running along a portion of a length thereof as illustrated in FIG. 7. The ribs 190 may extend from the outlet valve 139 end of the valve 130 towards the valve disc 136. Adjacent to the valve disc 136, the ribs 190 may narrow or converge towards the valve disc 136 as illustrated.

A cross-sectional view of the valve stem 133 and ribs 190 is illustrated in FIG. 9. As illustrated, the valve stem 133 and ribs 190 may form a cross shape or "X" shape. In other embodiments of the invention, two or three ribs 190 could be used instead of four. In addition, more than four ribs 190 could be used with various embodiments of the invention.

In still other embodiments of the invention, portions of the exterior surface of the ribs 190 may be configured such that they contact the walls of a base 310 when assembled with a base 310 of a pump. Such contact may provide further stability or may be used for assembly purposes to guide a valve 130 into a desired assembled position. In still other embodiments of the invention, one or more support ribs may be configured as part of a valve stem 133, or on a valve stem 133, in such a manner that when assembled with a base 310 of a pump, at least some of the one or more support ribs 190 contact a portion of an interior chamber of the base. During actuation of the pump and movement of the valve 130, contact between those portions of the valve stem 133 and the walls of the interior chamber of the base 310 may prevent flexion or movement in a direction other than parallel to the axis through the pump base 310 from the inlet orifice to the discharge passage 318.

According to some embodiments of the invention, a valve 130 having ribs 190 may provide a more rigid valve 130 than those of the prior art.

According to various embodiments of the invention, a valve stem 133 of a valve 130 may be shaped or configured to provide increased rigidity to the valve 130. For instance, a valve stem 133 may be a solid valve stem 133 having a narrowing portion adjacent a valve disc 136. In other embodiments, a valve stem 133 may include shaped features or ribs 190 running along a length or width of the valve stem 133 to provide support, rigidity, and stiffness to the valve stem 133 and the valve 130. In still other embodiments of the invention, the rigidity or stiffness of a valve 130 may be increased by utilizing a valve stem 133 shape which narrows as the valve stem 133 approaches a valve disc 136. Ribs 190 or other features may be added to the valve stem 133 to increase the rigidity or stiffness of the valve 130.

Figure 10:
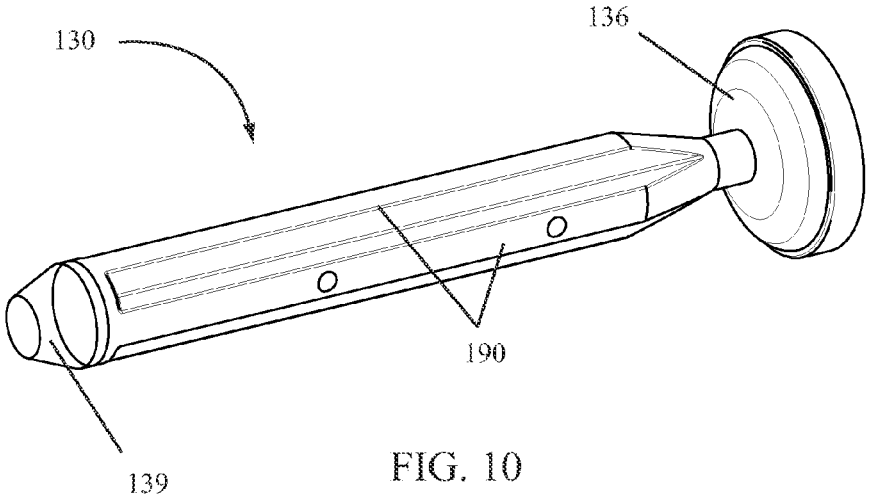
FIG. 10 illustrates a perspective view of a valve according to various embodiments of the invention.
Figure 11:
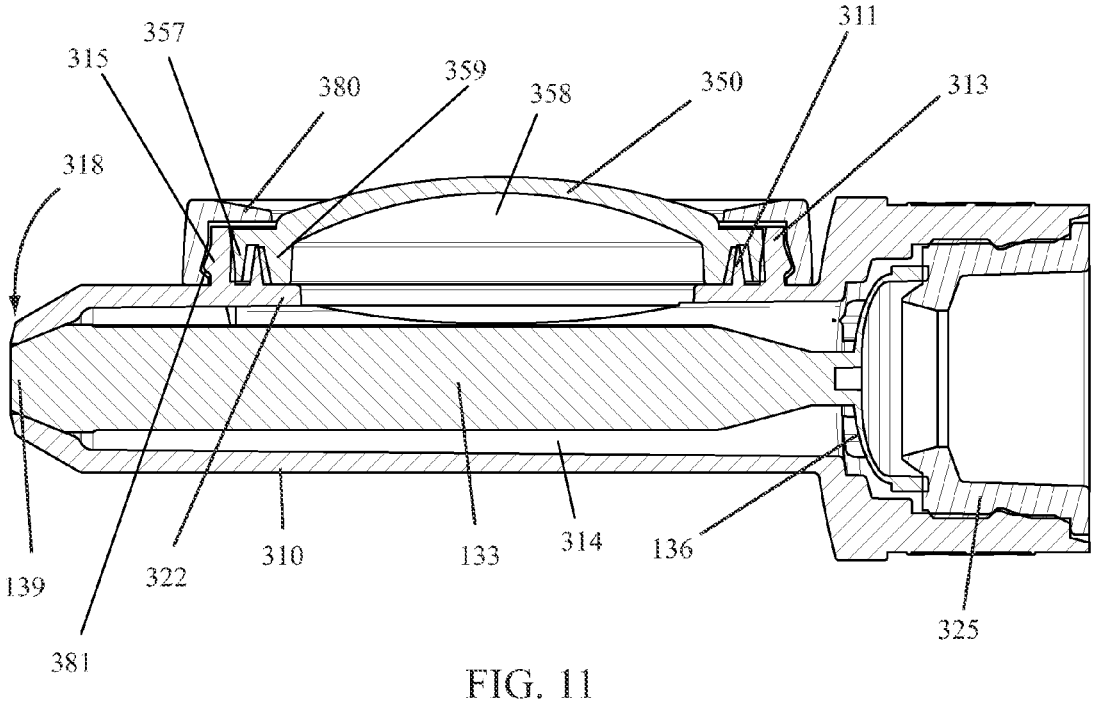
FIG. 11 illustrates a cross-sectional view of a pump including a bellows according to various embodiments of the invention.

A valve 130 according to still other embodiments of the invention is illustrated in FIGS. 10 and 11. As illustrated in FIG. 10, a valve 130 may include a conical outlet valve 139. Although rounded outlet valves may be used with various embodiments of the invention, it has been found that the use of a conical outlet valve 139 with a pump base 310 having a corresponding conical shaped discharge passage 318 provides a better seal or valve seat. Thus, in certain embodiments of the invention, a valve 130 may have a conically shaped outlet valve 139.

A pump assembled with a valve according to various embodiments of the invention is illustrated in FIG. 11. As illustrated, the pump may include a base 310 having a discharge passage 318. A valve 130 may be seated in the base 310 such that the outlet valve 139 seats against the discharge passage 318. An attachment adapter 325 may fit in an opposite end of the base 310 and secure the valve 130 within the base 310. In addition, the attachment adapter 325 may provide an inlet valve seat which mates with or contacts at least a portion of the valve disc 136 to provide an inlet valve for the pump from a container or pouch attached to the base 310 of the pump. A bellows 350 may be secured to the base 310 with a cap 380. Actuation of the bellows 350 with product in the base 310 may apply a force against the valve disc 136, which in turn may apply a force to the valve stem 133 and unseat the outlet valve 139 from the discharge passage 318, allowing product to flow from the pump as known.

According to some embodiments of the invention, a bellows 350 may sit, rest, or be positioned on a base rim 322. An opening defined by the base rim 322 may separate a bellows chamber 358 from the interior chamber 314 of the base 310. A bellows 350 may include a bellows rim 356 having an outer rim ring 357 and an inner rim ring 359. In some embodiments, an outer rim ring 357 and an inner rim ring 359 may straddle or be positioned on opposite sides of a base bellows ring 311 as illustrated in FIG. 11. A bellows 350 may also be positioned on the interior of a base cap ring 313 extending from the base 310 as illustrated in FIG. 11. A base cap ring 313 may also include one or more projections 315 capable of being snap-fitted or otherwise coupled with an indentation or projection in a cap 380. The fitment of a cap indentation or cap projection 381 to one or more projections 315 of a base cap ring 313 may secure the cap 380 to the base 310 and assist in holding a bellows 350 as part of the pump 300.

As illustrated in FIG. 11, a valve 130 having a conically shaped outlet valve 139 is seated in a conically shaped discharge passage 318 of a pump base 310. The seat of the conical shaped outlet valve 139 may be matched to the discharge passage 318 to provide a superior seal. In addition, it has been found that the use of a conical shaped outlet valve 139 as illustrated may provide an improved discharge of product. This is especially true where the valve 130 is a stiffened valve according to embodiments of the invention. For example, when using a valve 130 according to embodiments of the invention having a conical shaped outlet valve 139, discharge of a product from the pump is more controlled. The conical shape of the outlet valve 139 and corresponding shape of the discharge passage 318 provides an improved valve seat which stabilizes the flow of product out the discharge valve and provides a cleaner shut-off when the outlet valve 139 re-seats with the discharge passageway 318.

Figure 12:
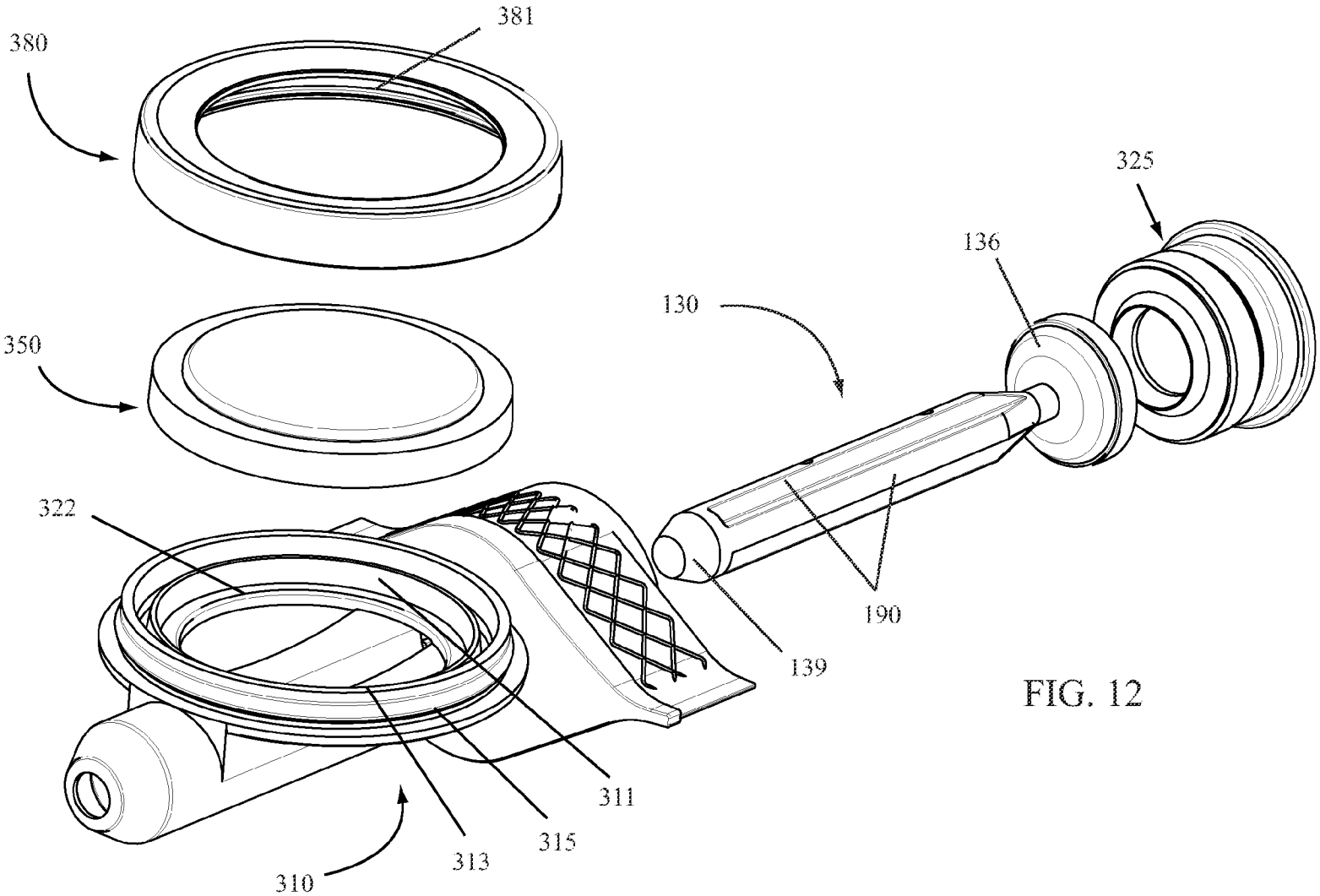
FIG. 12 illustrates a perspective, component view of a pump including a valve according to various embodiments of the invention.

A pump assembly according to various embodiments of the invention is illustrated in FIG. 12. As illustrated, a pump may include a base 310, a valve 130 fitted in the base 310, an attachment adapter 325 fitted into the base 310 to secure the valve 130 therein, and a bellows 350 secured with a cap 380. A bellows 350 may sit over a base bellows ring 311 and may rest on a base rim 322 while a cap 380 may snap-fit or otherwise connect to a base cap ring 313. In some embodiments of the invention, a base 310 may include a canoe shaped attachment for securing the pump to a pouch or other container. A valve 130 incorporated with—or assembled in—the pump may include a stiffened or rigid valve 130 according to embodiments of the invention. In addition, a valve 130 may include a conically shaped outlet valve 139 portion as illustrated.

Figure 13:
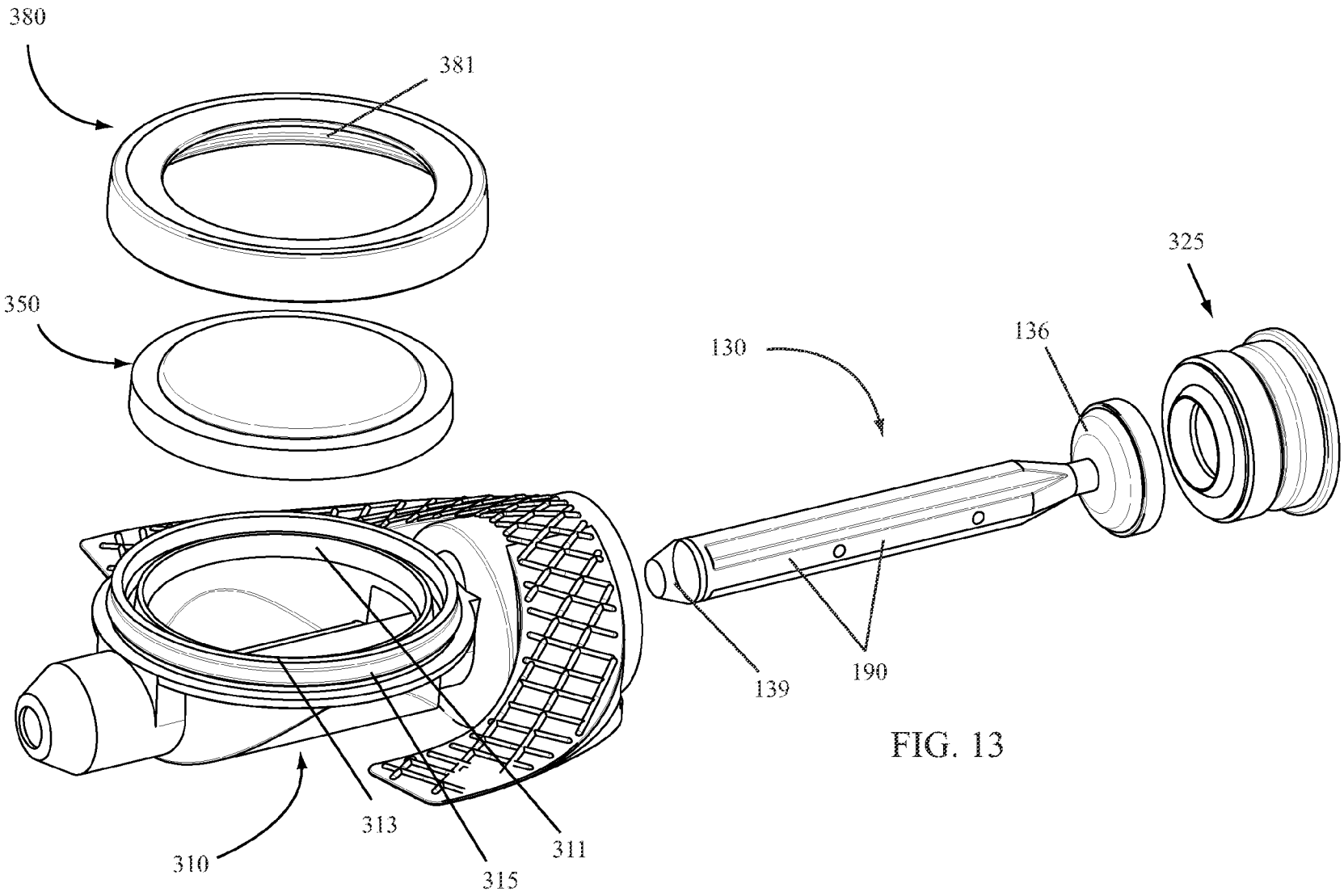
FIG. 13 illustrates a perspective, component view of a pump including a valve according to various embodiments of the invention.

A pump assembly according to various embodiments of the invention is illustrated in FIG. 13. As illustrated, a pump may include a base 310, a valve 130 fitted in the base 310, an attachment adapter 325 fitted into the base 310 to secure the valve 130 therein, and a bellows 350 secured with a cap 380. A bellows 350 may sit over a base bellows ring 311 on the edge of a base rim 322 and a cap 380 may snap-fit or otherwise connect to a base cap ring 313. In such embodiment, a portion of the bellows 350 may not be supported by the base 310 or base rim 322. In some embodiments of the invention, a base 310 may include a canoe attachment having a curved shape for securing the pump to a pouch or other container. A valve 130 incorporated with—or assembled in—the pump may include a stiffened or rigid valve 130 according to embodiments of the invention. In addition, a valve 130 may include a conically shaped outlet valve 139 portion as illustrated.

A valve 230 according to still other embodiments of the invention is illustrated in FIGS. 14 through 17. A valve 230 may be used in a pump and may include a valve stem 233, an outlet valve 239 and a valve disc 236. The outlet valve 239 and valve disc 236 may be on opposite ends of the valve stem 233.

Figure 14:
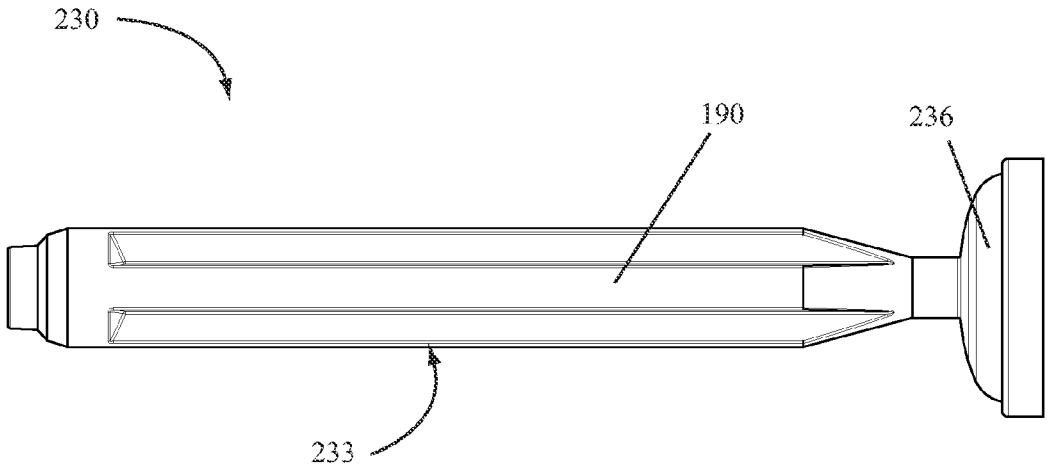
FIG. 14 illustrates a side view of a valve according to various embodiments of the invention.
Figure 15:
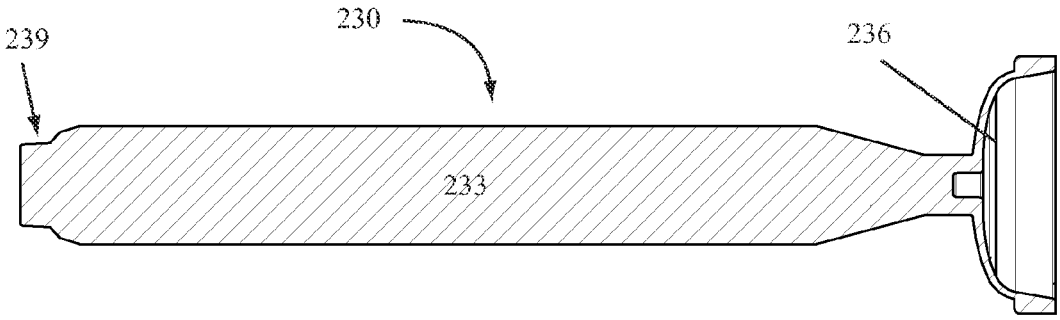
FIG. 15 illustrates a cross-sectional side view of a valve along its length according to various embodiments of the invention.
Figure 16:
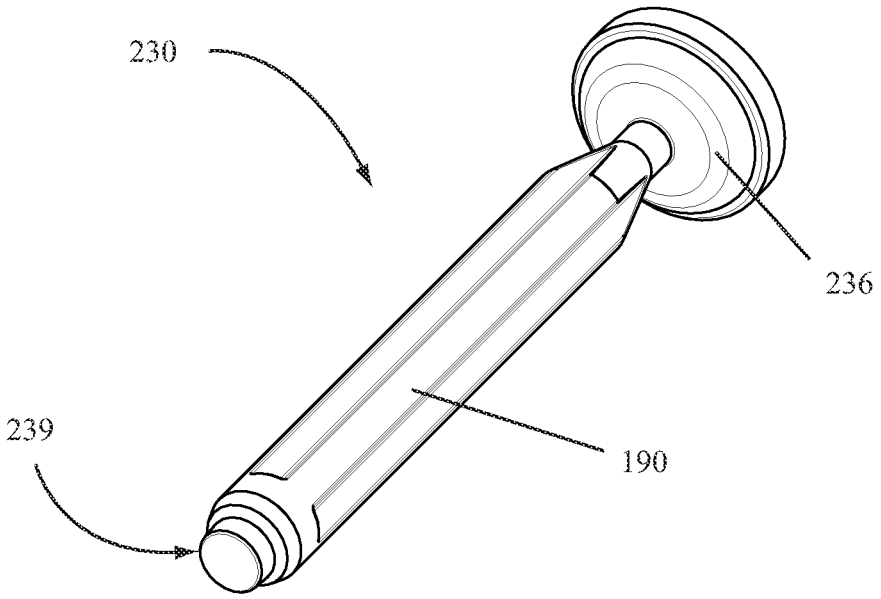
FIG. 16 illustrates a perspective view of a valve according to various embodiments of the invention.
Figure 17:
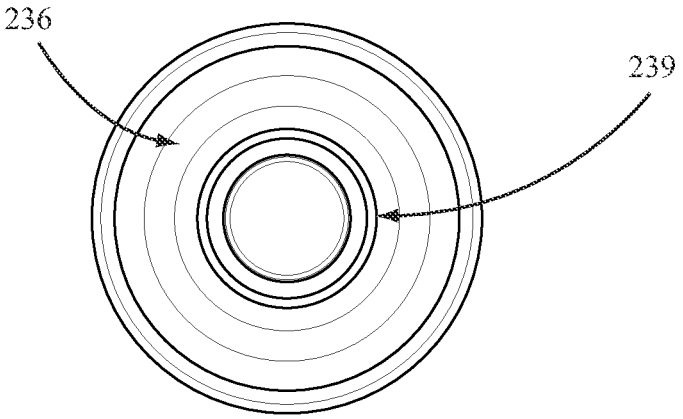
FIG. 17 illustrates an enlarged front view of the valve illustrated in FIG. 14.

As illustrated in FIG. 14, a valve 230 may include one or more ribs 190 or other stiffing features running along a length—or part of a length—of the valve stem 233. In other embodiments, ribs 190 or stiffening features may run along portions of the width or circumference of a valve stem 233.

According to various embodiments of the invention, a valve stem 233 may include four ribs 190 running along a portion of a length thereof. In other embodiments three or more ribs 190 may be used. For example, a valve 230 may include three ribs 190, four ribs 190, five ribs 190 or more running along a length of a valve stem 233. The ribs 190 may extend from the outlet valve 239 end of the valve 230 towards the valve disc 236. Adjacent to the valve disc 236, the ribs 190 may narrow or converge towards the valve disc 236 as illustrated. Convergence of the ribs 190 may be in a conical shape narrowing to a cylindrical portion between the ribs 190 and the valve disc 236 or in any other desired configuration. In some embodiments, ribs 190 may provide rigidity or support to the valve 230.

Figure 18:
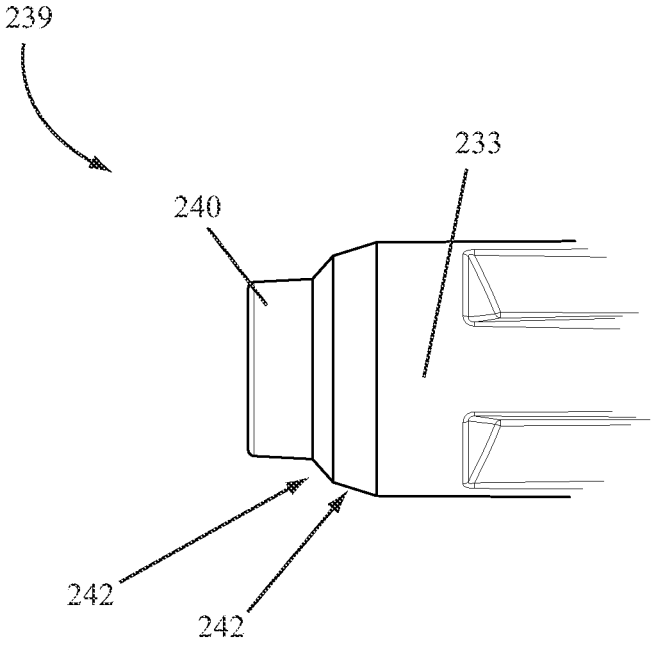
FIG. 18 illustrates an enlarged side view of an outlet valve portion of a valve according to various embodiments of the invention.
Figure 19:
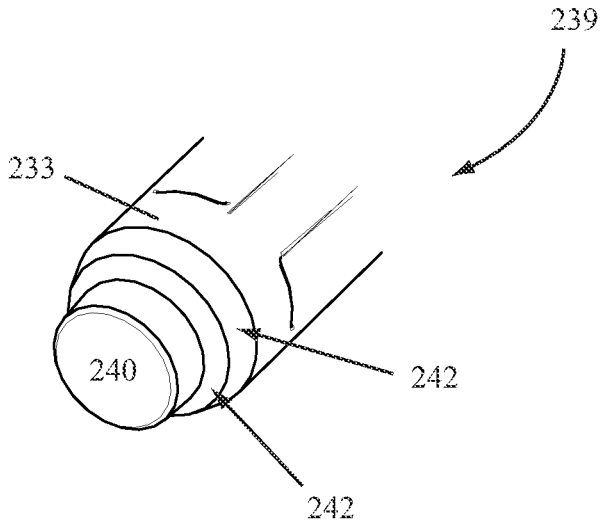
FIG. 19 illustrates an enlarged perspective view of an outlet valve portion of a valve according to various embodiments of the invention.

According to various embodiments of the invention, an outlet valve 239 portion of the valve 230 may include one or more steps or surfaces having different angles compared to other surfaces making up the outlet valve 239 portion of the valve 230. For example, as illustrated FIGS. 18 and 19, an outlet valve 239 may include a valve seal portion 240 at a forward end of the outlet valve 239. One or more surfaces 242 may extend from the valve seal portion 240 towards the valve stem 233 and join therewith. While the illustrated surfaces 242 in FIGS. 18 and 19 include two sloping surfaces, an outlet valve 239 may include one or more such surfaces extending or sloping away from the valve seal portion 240.

Figure 20:
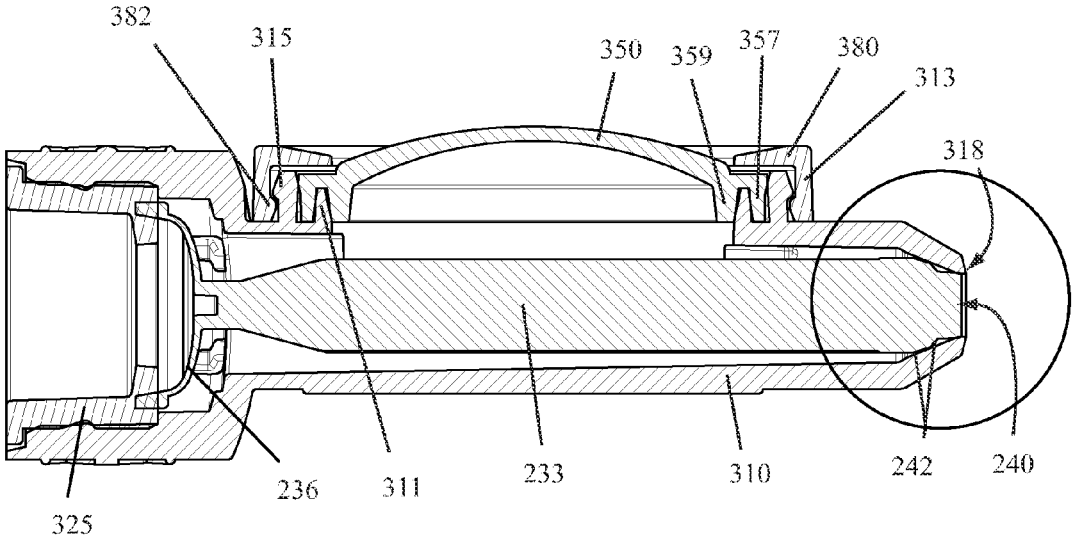
FIG. 20 illustrates a cross-sectional view of pump including a bellows according to various embodiments of the invention.
Figure 21:
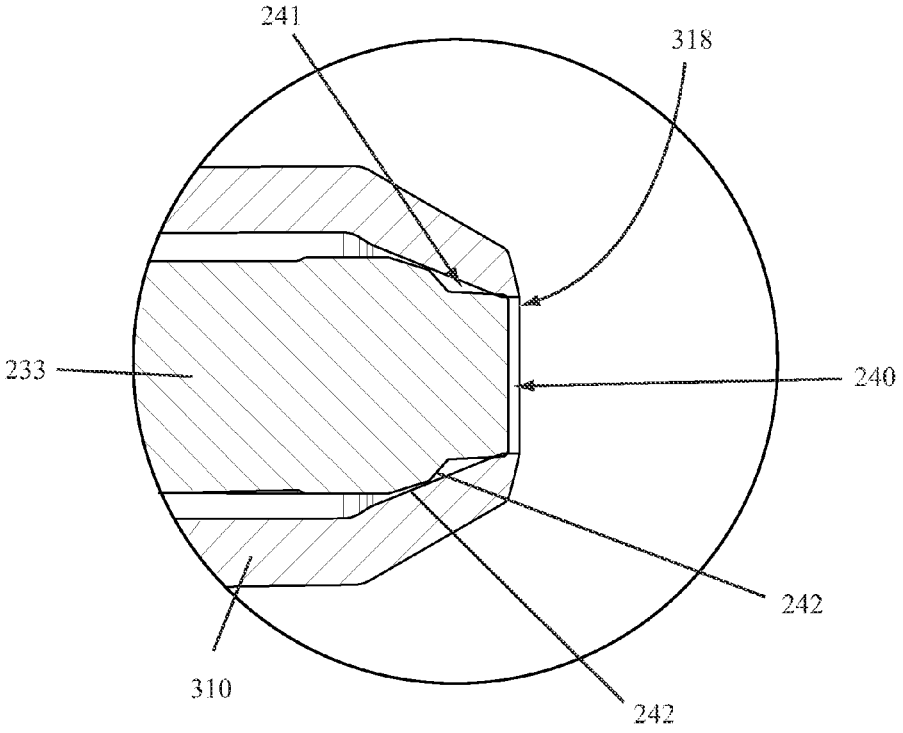
FIG. 21 illustrates an enlarged view of the outlet valve portion of the valve in the pump illustrated in FIG. 20.

According to various embodiments of the invention, when a valve 230 having an outlet valve 239 according to certain embodiments of the invention is inserted into a base 310 of a pump, the valve seal portion 240 may contact an interior wall of the base 310 of the pump at or near a discharge passage 318 of the base 310 as illustrated in FIG. 20. The valve seal portion 240 may contact the base 310 in such a way that the discharge passage 318 is closed or sealed by the outlet valve 239 such that product from within the pump cannot escape through the discharge passage 318. In addition, one or more pockets, gaps or openings may be formed between the outlet valve 239 and the inner wall of the base 310 adjacent to the valve seal portion 240. For example, FIG. 21 illustrates a blown-up view of the discharge passage 318 and outlet valve 239 illustrated in FIG. 20. As shown, the valve seal portion 240 of the outlet valve 239 seals against an interior wall of the base 310 near the discharge passage 318 to prevent product from escaping the pump. The valve seal portion 240 extends from its seal with the interior wall of the base 310 towards the valve stem 233 and meets the first of two surfaces 242. The surfaces 242 may be configured to provide or form one or more pockets 241, spaces or openings between the outlet valve 239 and the interior wall of the base 310.

The use of a valve 230 having an outlet valve 239 configured to provide a seal between a valve seal portion 240 and an interior wall of a base 310 of a pump, along with the inclusion of one or more pockets 241 may be advantageous when used with product formulations having particulate matter therein. For example, it has been found that use of a valve 130 having a cone shaped outlet valve 139 such as that illustrated in FIG. 10 with products containing particulates may lead to some of the particulates being trapped between the sealing surface of the cone shaped outlet valve 139 and the interior wall of the base 310 of the pump. When such particulates become trapped, there is an increased risk of a seal between the outlet valve 139 and the base 310 not being made and air entering the pump or a loss of prime resulting from air entering the pump chamber past the outlet valve 139. However, the use of an outlet valve 239 as illustrated FIGS. 18 through 21 avoids these issues and forms a better seal. In part, the one or more pockets 241 may allow the valve seal portion 240 to squeeze particulates back into the one or more pockets 241 such that the valve seal portion 240 is able to form a complete seal with the interior wall of the base 310 of the pump. The one or more pockets 241 may provide additional space into which particulates may congregate as the valve seal portion 240 seals against the interior wall of the base 310 instead of being pinched between the valve seal portion 240 and the interior wall of the base 310.

According to various embodiments of the invention, an outlet valve 239 may include a valve seal portion 240 and one or more surfaces 242 extending away from the valve seal portion 240 towards the valve stem 233 such that when the outlet valve 239 is seated in or near a discharge passage 318 of a pump, the outlet valve 239 creates a seal between the interior wall of a pump and the valve seal portion 240, one or more pockets 241, and a restricted space smaller than the one or more pockets 241 interior to the one or more pockets 241.

As illustrated in FIG. 20, a bellows 350 may be seated against a base 310 of the pump 300. A bellows 350 my include an inner rim ring 359 and an outer rim ring 357 straddling one or more base bellows rings 311. In the embodiment illustrated FIG. 20, the inner rim ring 359 is not supported by a base rim 22 as with the configuration illustrated in FIG. 11. A cap 380 may snap-fit or otherwise connect to the base 310. For example, a cap 380 may include one or more cap projections 381 which may interact with, connect to, or otherwise snap-fit with one or more projections 315 on a base cap ring 313 as illustrated.

Figure 22:
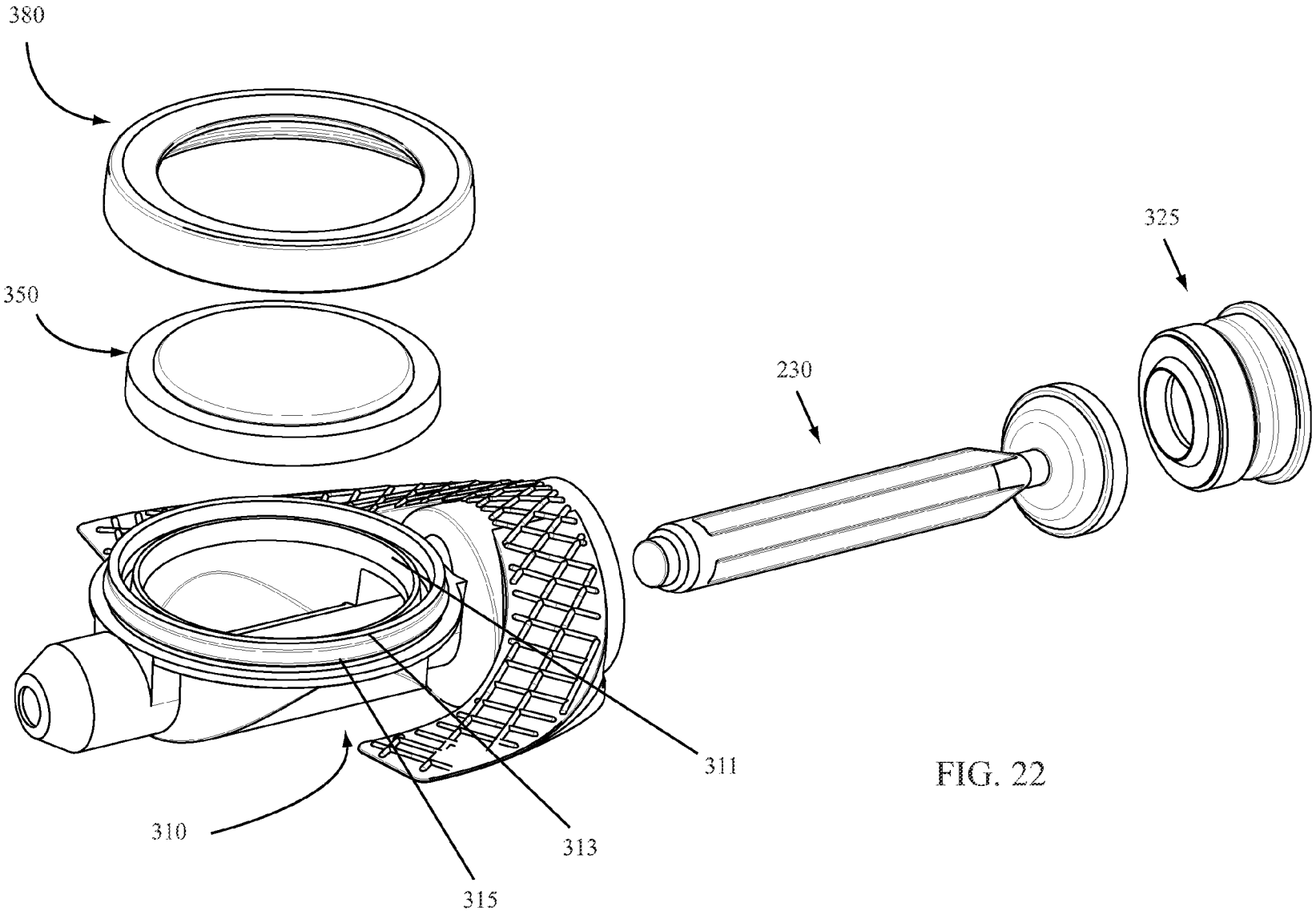
FIG. 22 illustrates a perspective, component view of a pump including a valve according to various embodiments of the invention.
Figure 23:
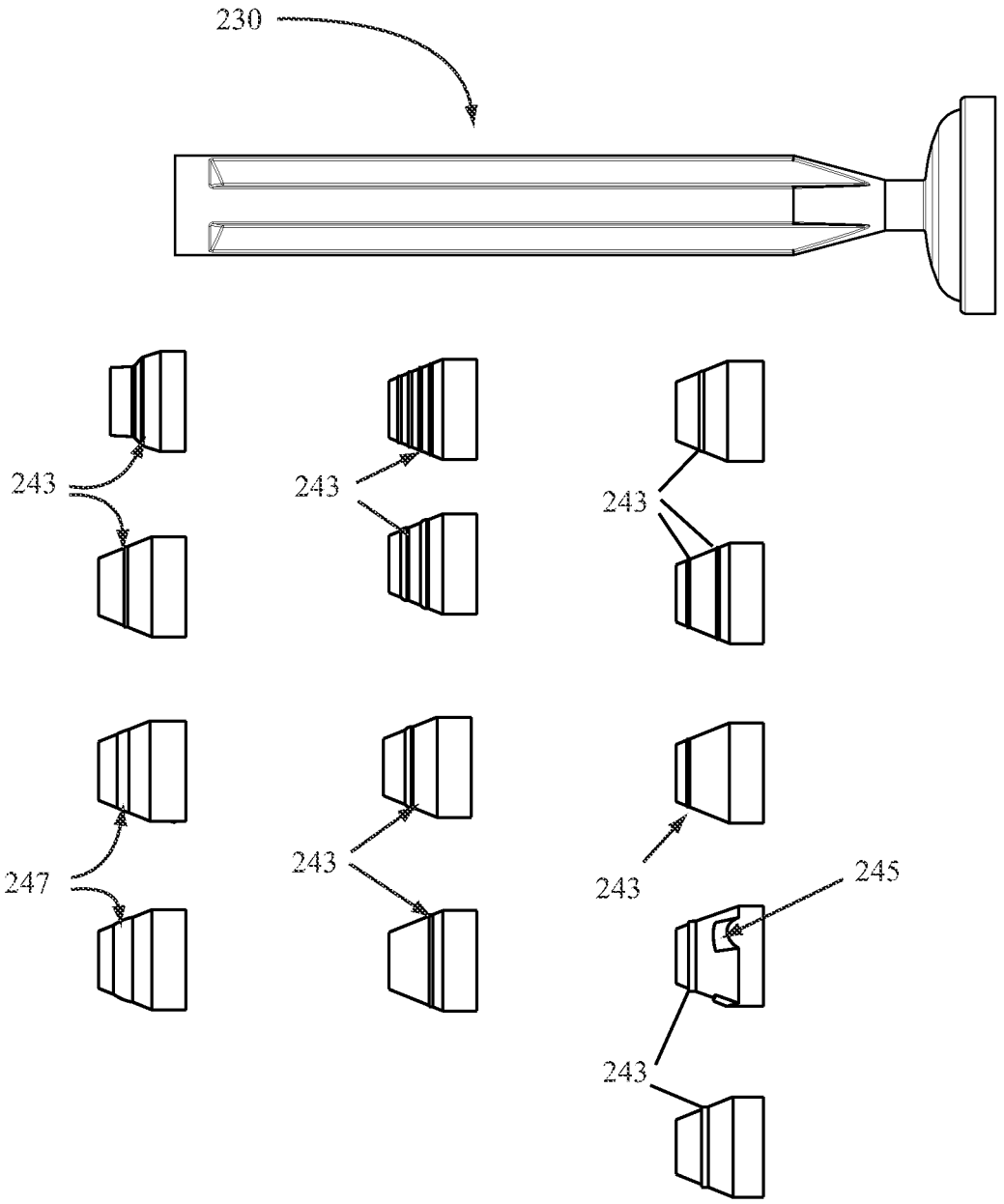
FIG. 23 illustrates a valve and multiple outlet valve configurations for a valve according to various embodiments of the invention.

A pump assembly according to various embodiments of the invention is illustrated in FIG. 22. As illustrated, a pump may include a base 310, a valve 230 which may be inserted into the base 310, an attachment adapter 325 fitted into the base 310 to secure the valve 230 therein, and a bellows 350 secured to the base 310 by a cap 380. In some embodiments, a base 310 may include a canoe having a straight or winged shape for securing the pump assembly to a pouch or container.

An outlet valve 239 according to still other embodiments of the invention may include one or more ridges 243 encircling all or part of the outlet valve 239 as illustrated in FIG. 22. FIG. 22 shows a valve 230 without an outlet valve 239 on the end and thirteen alternative configurations for an outlet valve 239 which may be used with various embodiments of the invention. As illustrated, one or more ridges 243 formed on a part of the outlet valve 239 may create pockets, spaces, or openings that may trap or contain particulates when an outlet valve 239 seats against a pump. The one or more ridges may be formed to create pockets 241. In addition, an outlet valve 239 may include one or more raised bands 247 capable of creating similar pockets, spaces, or openings relative to an interior of a pump such that particulates may be trapped in the pockets formed between the one or more bands 247 and an interior watt of a pump. In still other embodiments, one or more holes or divots 245 may be formed in the outlet valve 239 to provide pockets 241 between the outlet valve 239 and an interior wall of a pump.

A valve 230 having a particular outlet valve 239 configuration according to various embodiments of the invention may be molded as a unitary component using known molding methods.

According to various embodiments of the invention, a valve disc 236 may be conical in shape as illustrated in FIGS. 3 and 7 or it may be rounded or cup shaped as illustrated in FIGS. 10 and 14. According to some embodiments of the invention, the cup shape of a valve disc 236 may help facilitate movement of a valve 130, 230 in a parallel plane when in use. In some embodiments, the configuration of the cup shape may also be altered to adjust the force required to unseat an outlet valve 139, 239 from its seat against the base 310 of the pump.

Valves 130, 230 according to various embodiments of the invention may be made of a flexible material such as TPE, TPU, or other material as desired. In addition, valves 130, 230 according to other embodiments of the invention may be made of a different plastic or resin material.

Figure 24:
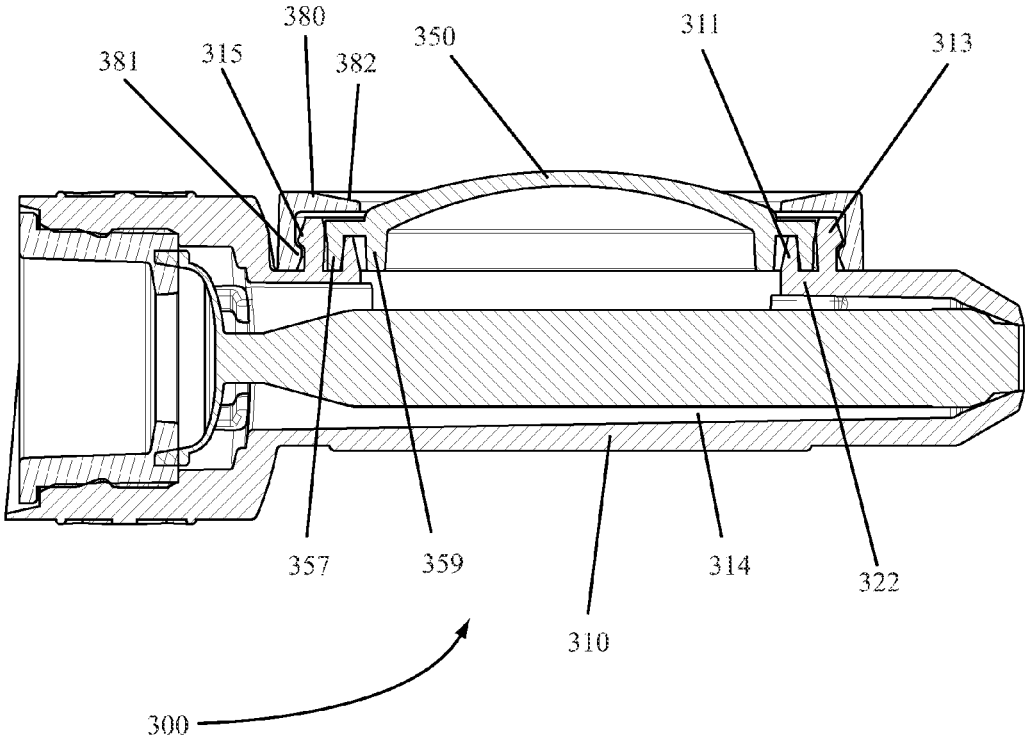
FIG. 24 illustrates a cross-sectional view of a pump including a bellows and cap according to various embodiments of the invention.

Improved bellows 350 and cap 380 configurations according to other embodiments of the invention are illustrated in FIGS. 24 through 30. As illustrated in FIG. 24, a pump 300 may include a base 310. The base 310 may include a base rim 322 defining an opening into an interior chamber 314 of the base 310. One or more base bellows rings 311 may extend upward or outward from the base rim 322. A bellows 350 may rest or sit on the base rim 322 with an outer rim ring 357 of the bellows 350 outside the base bellows ring 311 and an inner rim ring 359 inward of the base bellows ring 311. As illustrated in FIG. 24, the outer rim ring 357 may sit on the base rim 322. In some embodiments, the base rim 322 may end at the intersection of the base rim 322 and the base bellows ring 311 as illustrated in FIG. 24. In other embodiments—such as one embodiment illustrated in FIG. 11—the inner rim ring 359 may also sit-on or be supported by a base rim 322 which extends inward of the base bellows ring 311.

According to some embodiments of the invention, a space between an outer rim ring 357 and inner rim ring 359 may be configured or shaped to match the shape and size of the base bellows ring 311 such that the base bellows ring 311 fits snuggly in the space between the outer rim ring 357 and inner rim ring 359 as illustrated in FIG. 20.

According to other embodiments, the space between the outer rim ring 357 and inner rim ring 359 may be larger than the shape and size of a base bellows ring 311 such that each of the outer rim ring 357 and inner rim ring 359 need not touch or contact the base bellows ring 311. For example, as illustrated in FIG. 24, the outer rim ring 357 is abutted against the base bellows ring 311 but the inner rim ring 359 does not touch or contact the base bellows ring 311, allowing for a space between the inner rim ring 359 and the base bellows ring 311. A top portion of the base bellows ring 311 may contact a junction between the outer rim ring 357 and the inner rim ring 359 as illustrated. In some embodiments of the invention, the space between the inner rim ring 359 and base bellows ring 311 may be designed to provide particular elastomeric or functional characteristics to the bellows 350 and actuation thereof. For example, the configuration illustrated in FIG. 24 provides a lower force to actuate over the bellows 350 illustrated in FIG. 1 and allows the inner rim ring 359 to move relative to the base bellows ring 311 upon actuation.

In other embodiments, a space may exist between a base bellows ring 311 and an outer rim ring 357 as illustrated in FIG. 11, where the inner rim ring 359 abuts up against the base bellows ring 311.

A bellows 350 may be secured to a base 310 or held in place relative to a base 310 by a cap 380. According to various embodiments of the invention, a cap 380 may include features to secure the cap 380 to the base 310. Similarly, a base 310 may include features configured to mate with a cap 380 and secure the cap 380 with the base 310. For example, as illustrated in FIG. 24, a cap 380 may include one or more cap projections 381 extending from an interior surface of a skirt of the cap 380 inwardly or towards a centerline through the cap 380. A base 310 may include one or more projections 315 extending off the base 310 and configured to interact with the one or more cap projections 381 to secure the cap 380 to the base 310. In some embodiments of the invention, the one or more projections 315 may extend off of part of a base 310. In other embodiments, a base 310 may include a base cap ring 313 projecting upwardly from the base 310 and the one or more projections 315 may extend outwardly from the base cap ring 313 such that they may interact with a cap projection 381 of a cap 380. For instance, the pump 300 illustrated in FIG. 24 includes a base 310 having a base cap ring 313 with a ringed projection 315 about an outer surface of the base cap ring 313 and projecting outwardly therefrom. A cap 380 is snapped over the base cap ring 313 such that a cap projection 381 extending inwardly from an inner surface of the cap 380 mates with or snaps over the projection 315 of the base cap ring 313. The interaction of the projection 315 and the cap projection 381 secures the cap 380 to the base 310. Other snap-fitments, threads, bayonet connections, or the like may also be used with embodiments of the invention to secure a cap 380 to a base 310 as desired.

As illustrated in FIG. 24, a cap 380 may include a cap flange 382 having a underside surface which contacts or nearly contacts the bellows 350 in an assembled state. In the configuration illustrated in FIG. 24, a space may exist between the bellows 350 and the cap 380 which may allow the bellows 350 to flex or deform during actuation and return from actuation of the bellows 350.

Figure 25:
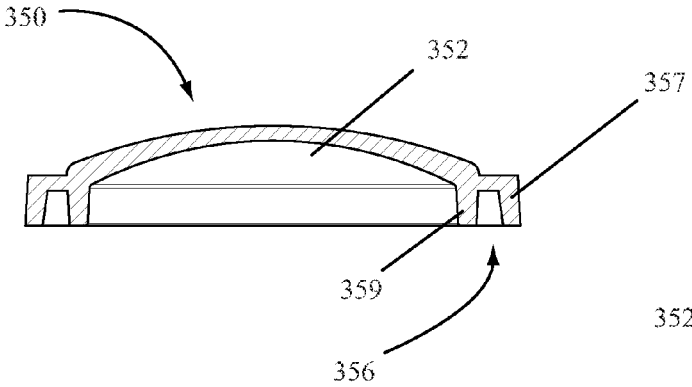
FIG. 25 illustrates a cross-sectional view of a bellows according to various embodiments of the invention.

A cross-sectional view of a bellows 350 according to various embodiments of the invention is illustrated in FIG. 25. As illustrated, a bellows 350 may include a bellows rim 356 which may include an outer rim ring 357 and an inner rim ring 359. A dome 352 extends from the bellows rim 356 to form an actuation pad or button. The configuration of the bellows 350 and the dome 352 allows the bellows 350 to flex during actuation and retract following actuation.

Figure 26:
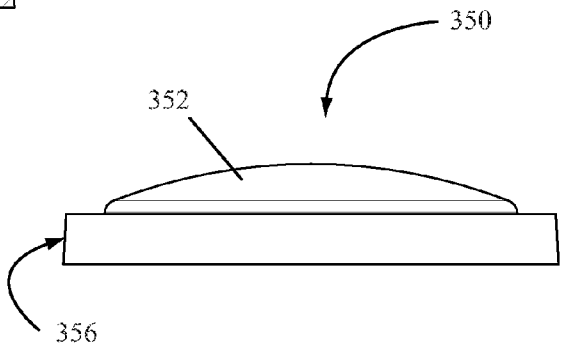
FIG. 26 illustrates a side view of a bellows according to various embodiments of the invention.

A side view of a bellows 350 according to various embodiments of the invention is illustrated in FIG. 26.

Figure 27:
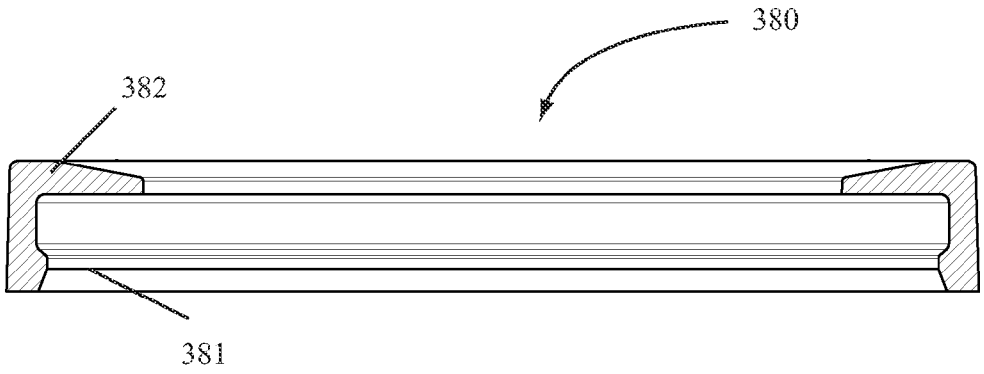
FIG. 27 illustrates a cross-sectional view of a cap according to various embodiments of the invention.

A cross-sectional view of a cap 380 according to various embodiments of the invention is illustrated in FIG. 27. As illustrated, a cap 380 may include an upper deck or cap flange 382 having a sidewall extending downward therefrom. The sidewall may include one or more cap projections 381 extending inwardly from an interior surface of the cap 380 sidewalls. The one or more cap projections 381 may be configured to mate with or secure a cap 380 to a base 310 of a pump 300. A cap 380 may be configured to retain a bellows 350 on a base 310 of a pump 300.

Figure 28:
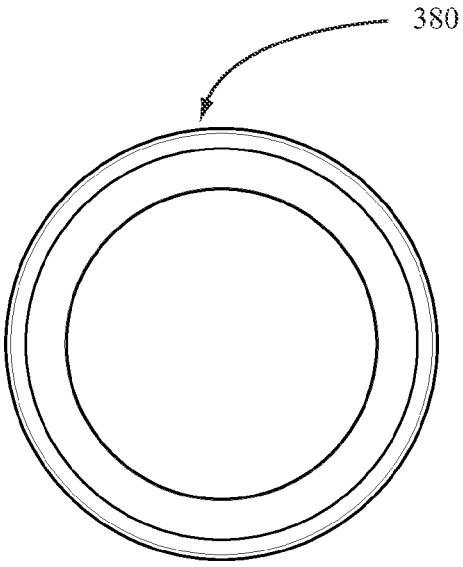
FIG. 28 illustrates a top view of a cap according to various embodiments of the invention.
Figure 29:
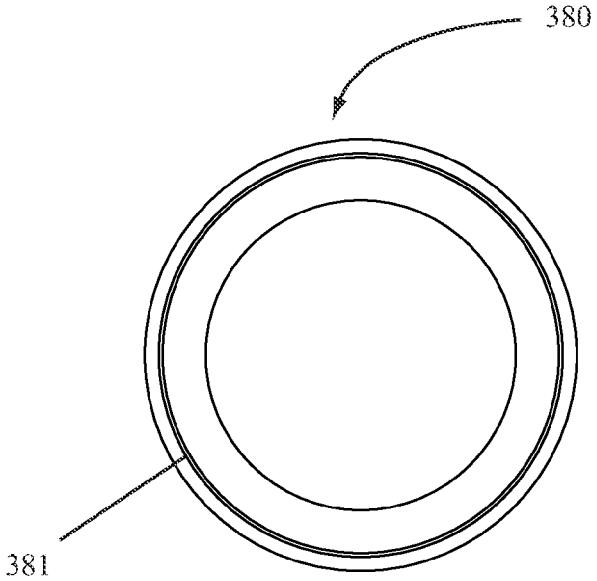
FIG. 29 illustrates a bottom view of a cap according to various embodiments of the invention.

Top and bottom views of a cap 380 according to various embodiments of the invention are illustrated in FIGS. 28 and 29.

Figure 30A:
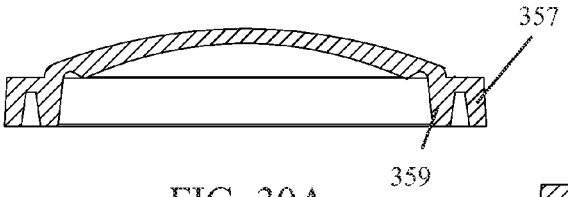
FIGS. 30A through 30G illustrate various views of bellows according to various embodiments of the invention.
Figure 30B:
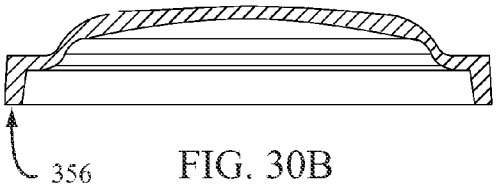
Figure 30C:
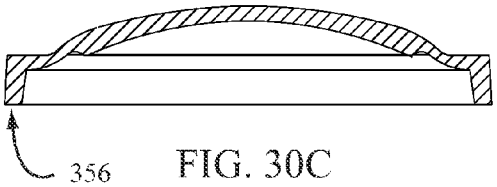
Figure 30D:
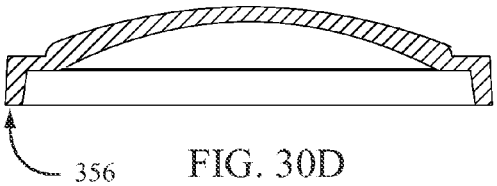
Figure 30E:
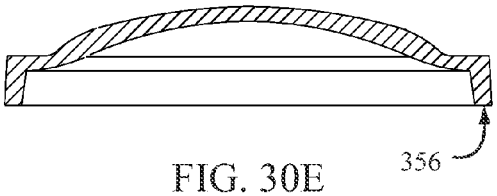
Figure 30F:
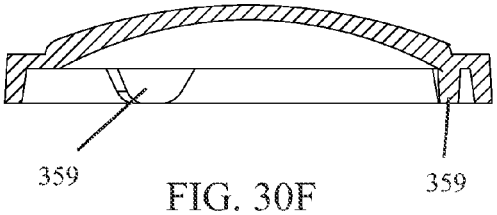
Figure 30G:
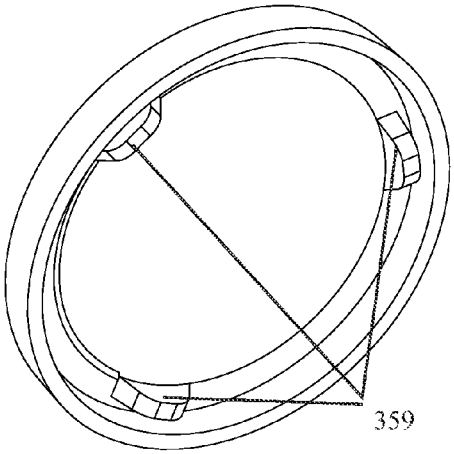

Alternate bellows 350 designs and configurations which may be used with particular embodiments of the invention are illustrated in FIGS. 30A through 30G. As illustrated, different bellows 350 dome 352 shapes may be used with various embodiments of the invention. In addition, a bellows 350 may include a single bellows rim 356 or a bellows rim 356 having both an outer rim ring 357 and an inner rim ring 359. According to some embodiments of the invention, a bellows 350 may include segments of an inner rim ring 359 as illustrated in FIGS. 30F and 30G. The segments of an inner rim ring 359 may help support the bellows 350 resting on a base rim 322 of a base 310 or may be configured to assist with the assembly of a pump 300.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump, comprising:
a base, comprising:
a base rim defining an opening into the base;
a base bellows ring extending away from the base rim at the opening; and
a base cap ring extending away from the base rim and encircling the base bellows ring;
a bellows, comprising:
an inner rim ring;
an outer rim ring encircling the inner rim ring;
wherein the outer rim ring is positioned between the base bellows ring and the base cap ring and the the inner rim ring is positioned interior of the base bellows ring without contacting the base;
a cap securing the bellows to the base;
a valve in an interior portion of the base, the valve comprising:
an outlet valve comprising a valve seal portion seated against an interior wall of the base and at least one surface extending into an interior of the base;
a valve stem in communication with the at least one surface; and
a valve disc at an end opposite the outlet valve; and
an attachment adapter seated against the valve disc and securing the valve in the base.

2. The pump of claim 1, wherein the outer rim ring and the inner rim ring of the bellows straddle the base bellows ring.

3. The pump of claim 1, wherein the outer rim ring rests on a portion of the base rim during non-use.

4. The pump of claim 1, wherein the base further comprises at least one projection extending outwardly from the base cap ring and interacting with the cap to secure the bellows to the base.

5. The pump of claim 4, wherein the cap further comprises:
a cap flange;
a sidewall extending downward from the cap flange; and
at least one cap projection extending inwardly from the sidewall, wherein the at least one cap projection snap-fits with the at least one projection on the base cap ring to secure the cap to the base.

6. A pump, comprising:
a base, comprising:
a base rim defining an opening into an interior of the base;
at least one base bellows ring extending from the base rim; and
at least one base cap ring extending from the base;
a bellows, comprising:
a bellows rim seated against the base rim, the bellows rim comprising:
at least one outer rim ring positioned exterior to the at least one base bellows ring; and
at least one inner rim ring positioned interior to the at least one base bellows ring;
a cap fitted to an exterior of the at least one base cap ring and configured to secure the bellows to the base;
a valve in an interior portion of the base; and
an attachment adapter seated in the base and securing the valve in the base.

7. The pump of claim 6, wherein the at least one outer rim ring is seated on the base rim.

8. The pump of claim 6, wherein the at least one outer rim ring and the at least one inner rim ring are seated on the base rim.

9. The pump of claim 6, wherein the at least one base cap ring further comprises at least one projection and the cap further comprises at least one cap projection.

10. The pump of claim 9, wherein the at least one projection and the at least one cap projection interact to secure the cap to the base and hold the bellows therebetween.

* * * * *